United States Patent [19]

Fantoni

[11] Patent Number: 4,934,266

[45] Date of Patent: Jun. 19, 1990

[54] PRINTING ROLLER FOR A ROTARY PRESS

[75] Inventor: Giuseppe Fantoni, Ozzano M.To, Italy

[73] Assignee: Officine Meccaniche G. Cerutti S.p.A., Casale Monferrato, Italy

[21] Appl. No.: 301,649

[22] Filed: Jan. 25, 1989

[51] Int. Cl.[5] ..... B41F 13/10; B41F 27/06

[52] U.S. Cl. ..... 101/375

[58] Field of Search ..... 101/375, 376, 378, 368, 101/348, 415.1

[56] References Cited

U.S. PATENT DOCUMENTS 4,381,709 5/1983 Katz ..... 101/375

4,656,942 4/1987 Vertegaal ..... 101/375

*Primary Examiner*—J. Reed Fisher

*Attorney, Agent, or Firm*—Peter K. Kontler

[57] ABSTRACT

A printing roller for a rotary press consists of a tubular, elastic, thin shell which is rigidly and tightly joined to the ends of the roller, the roller having peripheral chambers which contain a non-compressible fluid, and with means for displacing the fluid in order thus to increase the external diameter of the printing roller. The devices for displacing the fluid consist of a threaded spindle which can be screwed into a line which is operatively connected to chambers taking up the fluid. The threaded spindle is operatively connected to a coaxially arranged piston which can transmit a pressure force to the fluid in the chambers. The outer edges of the enveloping shell have two lateral enlargements to create a receptacle or a seat for the printing plate which is to be mounted thereon. The receptacle has a depth which corresponds to the thickness of the printing plate. In an advantageous manner, the outer edges of the edge enlargements are rounded. The enlargements can be produced by machining the shell, for example by removing material or by applying material; in the latter case, in an advantageous manner, by application of a material of the same type, having properties which are similar to those of the printing plate. For taking up printing plates which consist of plates wound up and fitted together at the ends, the shell has at least one longitudinal slot in which the butt joint of the printing plate is located and fixed.

13 Claims, 3 Drawing Sheets

PRINTING ROLLER FOR A ROTARY PRESS

BACKGROUND OF THE INVENTION

The invention relates to a printing roller for a rotary press, in which the printing plate in the form of a cylindrical wound plate is mounted rigidly on the outer surface of the printing roller by expanding a tubular, elastic, thin shell. The roller diameter is enlarged by the action of a non-compressible fluid on this shell from the inside, which action is controllable by devices for displacing the fluid.

Rollers for mounting tubular printing plates on rotary presses have already been disclosed, for example gravure plates, matrices for flexographic printing or for other enveloping bodies of a rotary press, such as, for example, rubber-like sleeves for contact pressure rollers, cylindrical printing plates for anilox rollers, casings for drive rollers and similar devices.

The known displacement devices, which are used for increasing the pressure in the fluid and for expanding the outer shell of the roller, have an actuating screw for generating a pressure force which acts directly on the fluid in the manner of a piston, frequently by interposition of a spring.

Due to the machining tolerances of the screw or threaded spindle, and of the threaded bore in the pressure line, pressure losses can arise which lead to a change in the fluid pressure and thus cause a change in the outer circumference of the shell. Another possible disadvantage is that the compression does not take place directly in the axial direction, which leads to further sealing losses and/or increased wear of the components. The use of a spring, together with a piston provided separately, requires the installation of three components, without eliminating the abovementioned disadvantages.

It is also necessary that the printing plate or, in some circumstances, the sleeve-like tubular envelope on the printing roller must be arranged with high accuracy in the axial direction of the roller, before expansion of the cylinder takes place, in order thus to avoid undesired shifts in the transverse direction. Furthermore, it must be taken into account that the edge regions of the known printing plate have sharp edges or edges angled off by 90°, which would disadvantageously affect the mode of operation of a wiping blade, that is to say that component which is provided for removing the ink excess and which moves to and fro in the longitudinal direction of the printing roller.

In particular when the printing plate was produced from a flat plate, it is always difficult to avoid sharp edges at the plate rims. As a result, the wiping blade is not only adversely affected in its oscillating movement and in its mode of functioning, but is also subject to heavier wear.

When a known printing roller is used in combination with a printing plate which consists of a flat metal plate coated with photosensitive material and wound in such a way that the printing plate assumes a cylindrical shape, a further disadvantage arises. Since the butt joint between the ends of the printing plate takes up a certain thickness, even though this thickening can be partially reduced, it is impossible to eliminate it completely.

When a roller is used which undergoes an enlargement in diameter, which is carried out in the conventional manner, a bulge or a projection extending in the longitudinal direction would result at the butt joint of the printing plate, which would lead to considerable difficulties in the use of this type of plate.

Alternatively, in order to avoid such enlargements at the butt joint of the printing plate, a different type of roller and a printing plate suitable for it have already been proposed, wherein the edges which have to be joined have a mutually complementary shaping which leads to a particularly complicated design of the edges, which is not free of restrictions.

The use of this known plate type is, however, particularly advantageous with respect to the manufacturing costs of the plate, both with respect to the necessary equipment and with respect to the time required for electroplating treatment and etching of these plates. However, the known advantages cannot be fully exploited, since an enlargement arising because of the mutual joining of the plate edges of these printing plates is formed at the butt joint on the inside of the cylindrical printing plate, because of the technical conditions described.

OBJECT OF THE INVENTION

It is the object of the above invention to avoid the disadvantages of the state of the art.

SUMMARY OF THE INVENTION

The object according to the invention is achieved by using a printing roller for a rotary press, which printing roller has a tubular, elastic, thin shell which is rigidly and tightly joined to the ends of the roller body and has peripheral chambers in which a non-compressible fluid is provided, and with means for displacing the fluid in order to increase the outer circumference of the printing roller, the printing roller being characterized in that the displacement device consists of a threaded spindle which is screwed into a line which is operatively connected to the fluid chambers, and the threaded spindle has a seat at its end and is operatively connected to a head-like enlargement of a piston, and the piston has, at its other end, annular grooves for receiving sealing rings.

According to a further feature of the invention, the ends of the tubular shell surface have enlargements of material, in order thus to provide a seat or a recess for arranging the printing plate, the thickness of the enlargement being equal to the thickness of the printing plate, and the outer edges of the enlargement are provided with a rounding.

According to a further feature of the invention, the shell surface of the roller has at least one longitudinal groove or a longitudinal slot for taking up and holding the butt joint of the printing plate which consists of a wound plate fitted together at its ends.

Further features and advantages of the invention can be taken from the description, which now follows, of several illustrative embodiments which are not to be regarded as restrictive solutions, and from the attached drawings in which:

DESCRIPTION OF PREFERRED EMBODIMENTS

Figure 1:
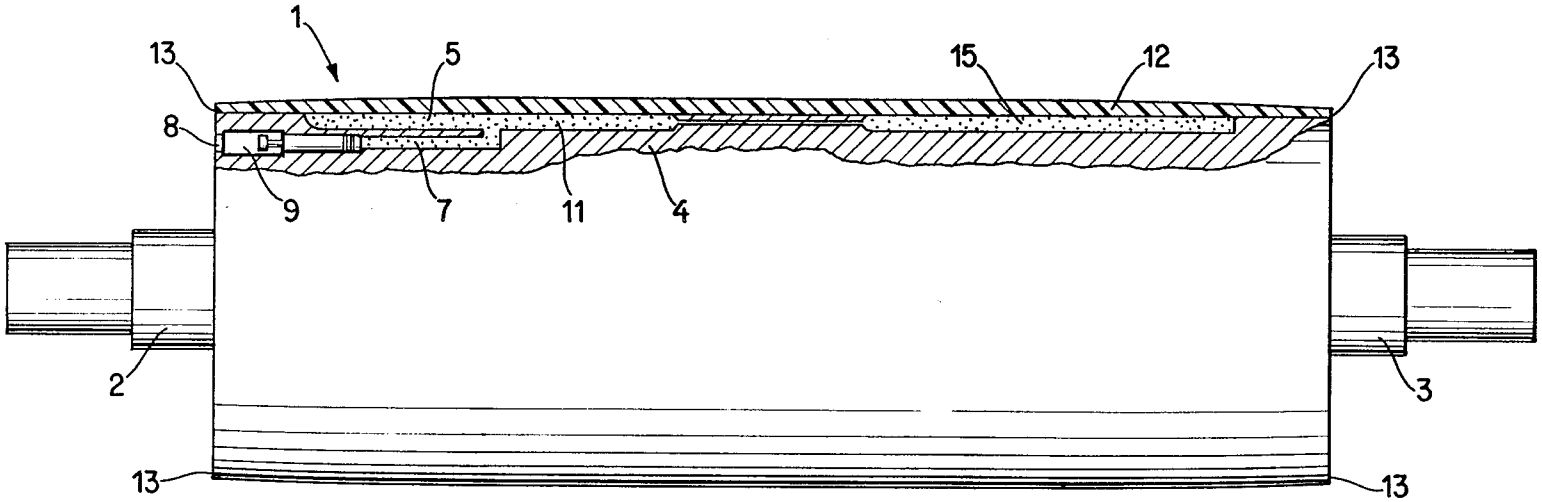
FIG. 1 shows a printing roller according to the above invention, partially in section.

The printing roller according to the invention, which is shown in its basic outline in FIG. 1 and is marked by the reference symbol 1, has two lateral bearing journals 2 and 3 for mounting in the rotary press.

Peripheral chambers 5 of relatively flat shape are worked into the substantially cylindrical peripheral surface of the roller body 4. These chambers 5 are filled with a non-compressible fluid (liquid) 11 and connected via a line or passage thereof 7 to the outside of the roller. Displacement devices, which are diagrammatically marked 9 and will be described more exactly below, are inserted from the outside 8 of the roller into the line 7. In the case of printing rollers of small lengths, it can be sufficient to provide a single peripheral chamber 5.

The body 4 of the roller is covered by a cylindrical, tubular, thin shell 12 which consists, for example, of spring steel or of plastic or of other suitable materials. This elastic shell 12 is rigidly and tightly joined to the end portions of the body 4 of the roller 1, for example by means of a welded joint or other suitable joining possibilities, which are marked 13.

The printing plate, not shown in FIG. 1, is drawn over the continuous external surface of the shell 12. This printing plate can be freely displaced on the tubular shell when the fluid 11 is not pressurized. Once the tubular printing plate has been positioned on the roller 1, the fluid 11 is pressurized by the displacement device 9, and the outer diameter of the roller is enlarged due to the elasticity of the shell 12. The printing plate is thus mounted in a predetermined position uniformly across the entire roller surface.

The construction of the printing roller described so far is essentially already known and will therefore not be explained in further detail.

Referring to FIGS. 2–4*a*, the displacement device 9 of the invention is now described in more detail.

The displacement device 9 consists of a reciprocable piston 20 which is mounted in the line 7 to be displaceable in the longitudinal direction and has a head 25 at one end and is provided at the other end with annular grooves 28 for receiving sealing elements in the form of rings 24. The piston 20 is articulately connected to a rotary member 21, advantageously a threaded spindle, but is not rigidly joined to the latter. The threaded spindle 21 has a recess 22 for introducing a key. The spindle has an external thread 29 which meshes with an internally threaded portion a thread 23 of the body 4 of the outward-pointing outlet of the line 7.

The taking-up seat or socket 26 (FIGS. 4–4*a*) of the threaded spindle 21 is suitable for taking up the head 25 of the piston 20. The head is guided via a narrowing 27 of the piston in a narrowed seat 30 of the threaded spindle 21. As can be seen clearly, the head 25 of the piston is arranged in the seat 26 with a certain amount of play. As a result, forces arising, which are not precisely in the axial direction, are compensated.

Thus, by the functional separation of the piston chamber from the threaded chamber, the displacement device becomes very accurate and efficient in its mode of operation. Any tolerances which may arise in the manufacture of the threaded spindle 21 or the thread in the line 7, do not affect the sealing effect of the device. Moreover, there will be no stresses due to an axial deviation of the components, since there is no rigid connection between the piston head 25 and the threaded spindle 21. The proposed type of construction is particularly simple. The parts can be mounted easily, and it is possible easily to exchange individual components.

Figure 2:
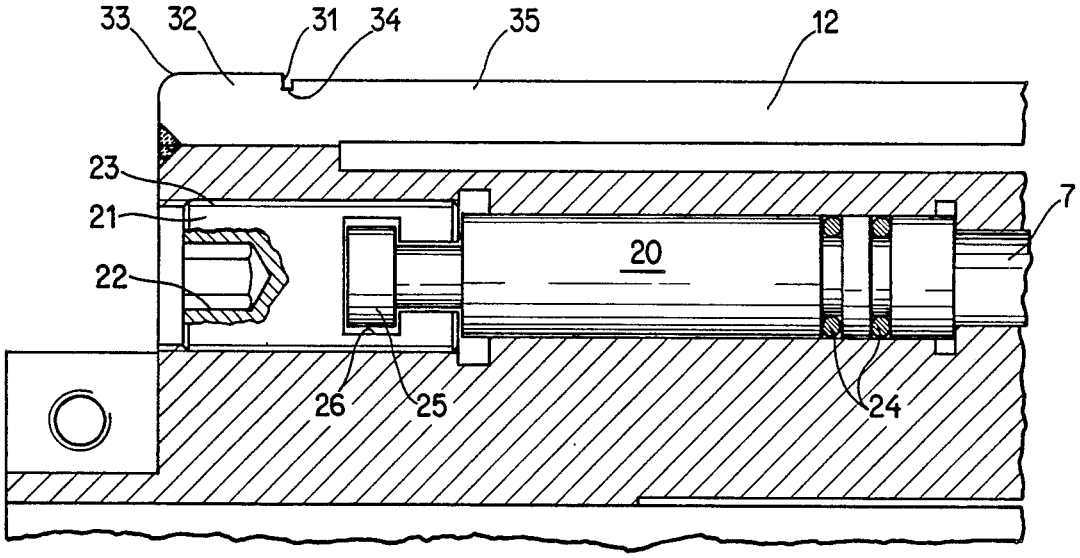
FIG. 2 shows, in section, a detail of the printing roller, wherein the displacement device and the seat for the printing plate are shown.
Figure 3:
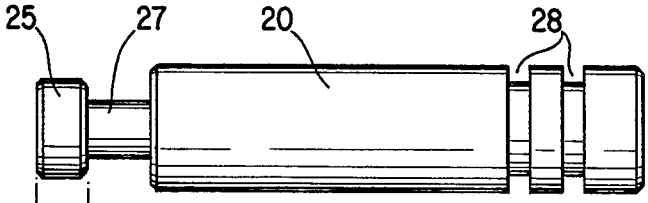
FIGS. 3 and 4 show, in detail, the threaded spindle for actuating the piston.
Figure 4:
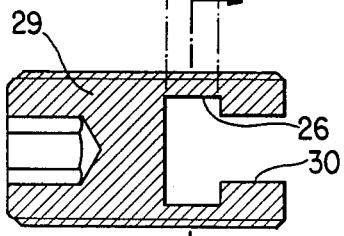
Figure 4A:
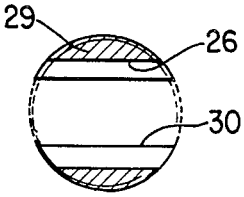
FIG. 4*a* shows the seat for taking up the head piece of the piston.

Still with reference to FIG. 2, a further feature of the invention is described.

As can be seen from this illustration, the outer surface 35 of the shell 12 has, at one end, or at both ends (only the left-hand end piece is shown in the figure), an enlargement 32 relative to the remaining material of the shell 12. This provides a seat or receptacle for the printing plate. The seat consists of the shell 12 and of stops 31 which are formed by the enlargement 32.

The depth of the seat or receptacle is equal to the thickness of the printing plate which is to be used and which, for reasons of clarity, was not shown in the drawing. This ensures that, when a printing plate is mounted on the roller 1 in coincidence with the receiving seat, the outer edge zone of the printing plate comes to lie flush with the outer surface of the enlargement 32.

The outer edges of the enlargement 32 have also roundings 33. The seat for the printing plate, not shown in FIG. 2, is produced by mechanical treatment of the shell 12 and has a peripheral groove 34 which, however, has no effect on the functioning of the roller. Alternatively, it would also be possible to remove the material by chemical or electrochemical means.

As a result, no interruption in the roller surface is detected by the wiping blade which serves to remove excess printing ink and moves to and fro parallel to the roller 1. In particular, the wiping blade no longer encounters an edge which is sharply deflected by 90° and which is inevitable in the case of conventional wound plates.

Figure 5:
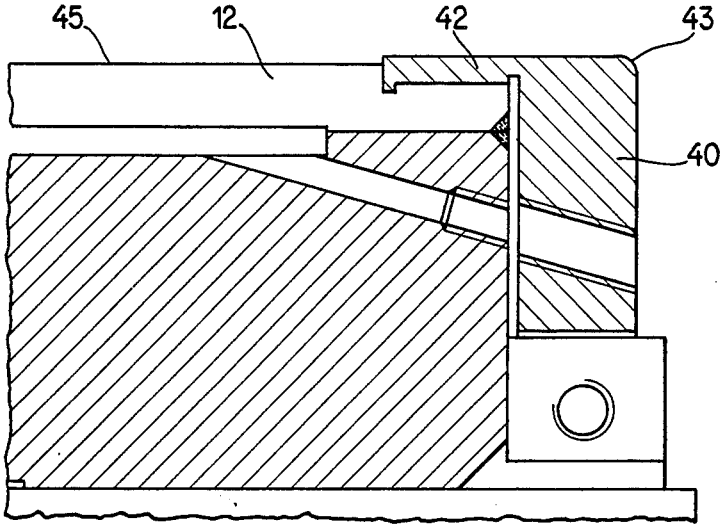
FIG. 5 shows a detail of a further embodiment of the take-up seat.

Alternatively, as shown in FIG. 5, the seat can also be formed by means of two laterally arranged enlargements 40 which have cover parts 42 resting on the cylinder end which has a smaller diameter in order to form a projection relative to the surface 45 of the shell, which projection corresponds to the thickness of the printing plate.

The outer edge 43 is here again rounded, and the component 40 can be fixed to the shell by means of screws, an adhesive bond, a weld or similar joining means.

Other alternative embodiments are also possible, such as, for example, provision of the enlargement on only one side of the roller shell.

In a preferred manner, if the receiving seat is produced by lateral enlargements, these enlargements are made of a material, the features of which are similar to the features of the photosensitive coating material which forms the outer surface of the printing plate. Features which would have to be similar relate to the coefficient of friction and to the hardness of the material, in order thus to avoid any interruption in the continuity of the wiping blade movement.

Owing to the above-described feature of providing a peripheral recess for receiving the printing plate, wherein the entire wall thickness of the printing plate is to be accommodated, and by the provision of rounded edges, an outer diameter across the entire width of the roller is achieved, which ensures continuity over the entire roller length, and this substantially simplifies the wiping step. In an alternative solution, it can be provided that only one end of the roller has an enlargement.

In the case where the printing plate is formed as a closed sleeve or as an assembled sleeve with a continuous profile, both in the peripheral direction and in the radial direction, the surface (35, 45) of the shell appears to be continuous.

In the case where a printing plate is used which is in the form of an assembled sleeve, in order to obtain a continuous wound plate in which the butt join forms a double bend located on the inside, the shell 12 of the roller has, according to the invention, at least one recess or longitudinal groove 50, such as is shown in various illustrative examples in FIGS. 6–10. The recess 50 shown in FIG. 6 extends in the longitudinal direction in parallelism with the axis of the shell 12 and has a depth which is greater than its width. This recess is made a little wider than the width dimension of the double bend, in order thus to allow easy introduction of the latter into the recess. The groove-like recess extends inwardly from the external surface of the shell in the radial direction.

As an alternative, the groove 50 could also extend at an angle to the axis of the shell 12, namely in the case where the butt joint of the printing plate is provided at an angle to the shell, usually along a slightly inclined angle, in order not to have to accept an unduly great reduction in the area which can be utilized for the printing process.

Figure 7:
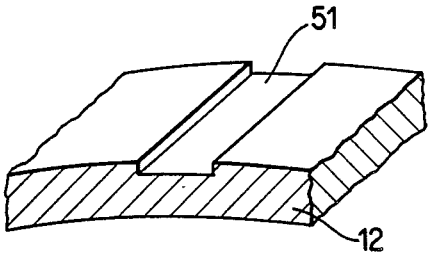

In the embodiment shown in FIG. 7, the slotlike opening 51 has a small depth in the radial direction but its width in the circumferential direction of the shell is substantially greater than its depth. This type of recess is suitable for taking up and fixing a printing plate, in which the butt joint was bent over in order thus to minimize the thickness of the butt joint. With this groove, a smaller depth of the recess is required, and there is thus very little weakening of the shell.

Figure 8:
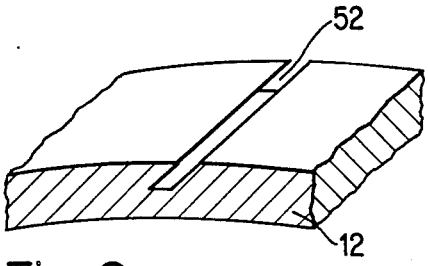

FIG. 8 shows an embodiment in which the groove-like undercut recess 52 is at an angle to the radial direction of the roller to receive a butt joint in which the plate joints are not arranged at 90° to the printing plate surface and also have not been completely bent over. In this way, a depth of the recess is obtained which is smaller than the actual height of the butt joint, without it having been necessary to resort to complete bending over of the joints. The choice of the type of groove depends on various factors, inter alia on the thickness of the roller shell, which thickness can reach up to 10 mm.

Figure 9:
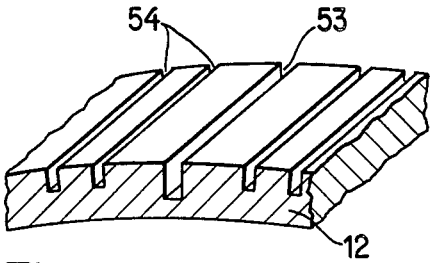

In FIG. 9, a further embodiment is shown in which at least one recess or slot 53 for taking up the junction, and also a further number of slots or incisions 54, which are distributed over the outer surface of the shell 12, are provided. These latter slots have a compensating function and serve mainly to avoid the formation of an oval shell periphery and/or to reduce peak stresses. The incisions can be covered by elastic envelopes of steel or plastic, if required.

Figure 10:
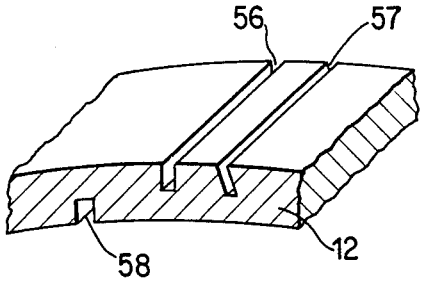

In FIG. 10, a further embodiment is shown, in which the groove or recess for taking up the butt joint is marked 56. A further incision or slot 57 is located in a position inclined relative to the recess, and a third groove or slot 58 is provided in the internal surface of the shell 12. With this embodiment, a so-called clamping effect over the edges of the groove is achieved due to their expansion, which the shell undergoes when the field in the chamber 5 is pressurized. In this way, an advantageous clamping effect for the printing plate on the shell 12 is obtained.

Figure 6:
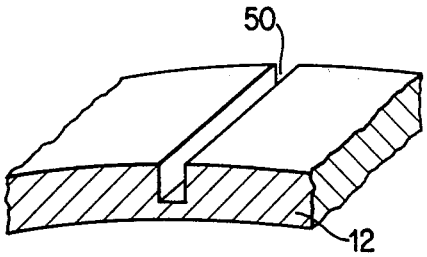
FIGS. 6–10 show, partially in section, various embodiments of the roller shell with slot-like recesses for taking up the butt joint of the printing plate.

As already described for the embodiment according to FIG. 6, several grooves can also be provided for taking up the butt joint of the printing plate, and the groove or grooves can be arranged at an angle to the circumferential lines of the surrounding shell, if the junction of the printing plate is arranged at an angle.

This object described is achieved by the invention. By the provision of a separately arranged piston which is operatively connected to a threaded spindle, the possibility of leakage losses and pressure losses, due to machining tolerances and lack of precise alignment of the line provided with a thread and of the chamber receiving the piston, is largely avoided. The provision of a recess or a seat in the peripheral direction of the printing plate makes it possible to create a smooth printing surface without interruptions, which substantially simplifies the wiping step, also owing to the rounding of the outer edges. Finally, the provision of one or more longitudinal grooves makes it possible also to use printing plates which are made as wound plates and in which the thickness of the abutment is not negligible.

I claim:

1. A printing roller comprising a body having first and second end portions and a peripheral surface extending between said end portions and having at least one chamber containing a supply of liquid; a thin, elastic tubular shell surrounding said peripheral surface and sealingly secured to said end portions; and means for pressurizing the liquid in said at least one chamber so that the liquid bears against said shell, including a reciprocable piston member extending into said at least one chamber and means for moving said piston member relative to said body, said moving means comprising an externally threaded rotary member articulately connected with said piston member so that said rotary member can rotate relative to said piston member but the piston member shares axial movements of the rotary member, said body having an internally threaded portion meshing with said rotary member so that the rotary member moves axially in response to rotation relative to said body.

2. The roller of claim 1, wherein said chamber includes a passage for said piston member and said piston member has at least one annular sealing element engaging said body in said passage.

3. The roller of claim 1, wherein one of said members has a socket and the other of said members has a head which is received with play in said socket.

4. The roller of claim 1, wherein said shell has a continuous external surface.

5. The roller of claim 1, wherein said shell has an external surface which is provided with at least one elongated recess for an internal butt joint of a printing plate when the printing plate is placed around said shell.

6. The roller of claim 5, wherein said recess is parallel to the axis of said shell.

7. The roller of claim 5, wherein said recess is inclined with reference to the axis of said shell.

8. The roller of claim 5, wherein said recess extends radially inwardly from the external surface toward the axis of said shell.

9. The roller of claim 5, wherein the depth of said recess in the radial direction is greater than the width thereof in the circumferential direction of said shell.

10. The roller of claim 5, wherein the width of said recess in the circumferential direction is greater than the depth thereof in the radial direction of said shell.

11. The roller of claim 5, wherein said recess is an undercut slot.

12. The roller of claim 5, wherein said external surface has at least one slot, the depth of said recess in the radial direction of said shell exceeding the depth of said slot.

13. The roller of claim 5, wherein said shell has an internal surface and at least one slot in said internal surface.

* * * * *